United States Patent [19]

Williams

[11] 4,243,290

[45] Jan. 6, 1981

[54] SHIELD TERMINATION MEANS FOR ELECTRICAL CONNECTOR

[76] Inventor: Robert A. Williams, 55 Bounty Rd. East, Fort Worth, Tex. 76116

[21] Appl. No.: 955,910

[22] Filed: Oct. 30, 1978

[51] Int. Cl.[3] ..... H01R 13/698; H01R 17/18

[52] U.S. Cl. ..... 339/143 R; 339/256 RT; 339/177 R

[58] Field of Search ..... 339/143 R, 177 R, 177 E, 339/89 C, 90 C, 256 RT, 258 R; 174/35 R, 35 C

[56] References Cited

U.S. PATENT DOCUMENTS

| | | | |
|---|---|---|---|
| 3,099,506 | 7/1963 | Tuchel | 339/143 R |
| 3,622,952 | 11/1971 | Hilbert | 339/177 A |
| 3,990,765 | 11/1976 | Hill | 339/143 R X |
| 4,106,839 | 8/1978 | Cooper . | |

*Primary Examiner*—Mark Rosenbaum
*Assistant Examiner*—Eugene F. Desmond
*Attorney, Agent, or Firm*—Arthur F. Zobal

[57] ABSTRACT

A shield termination means comprising an annular member having a plurality of axially extending fingers for terminating individual wire shields and/or a bulk cable shield against the inside wall of a back shell accessory body or around the cable leading into the accessory body.

25 Claims, 12 Drawing Figures

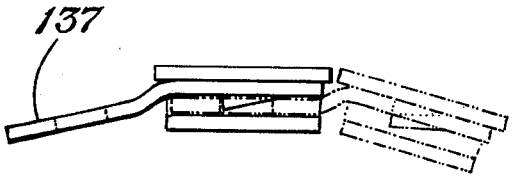
Fig. 8
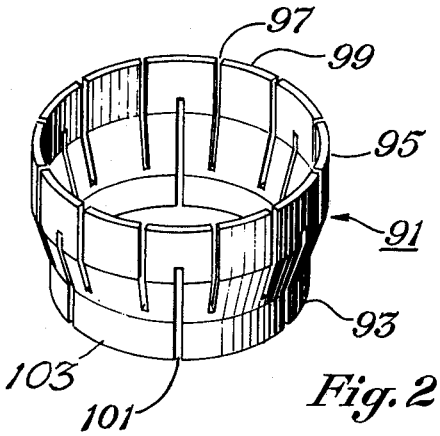
Fig. 2
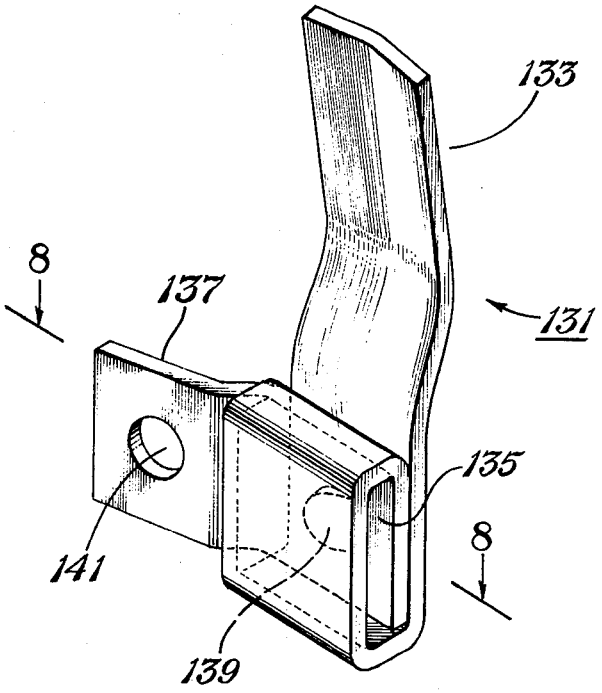
Fig. 7
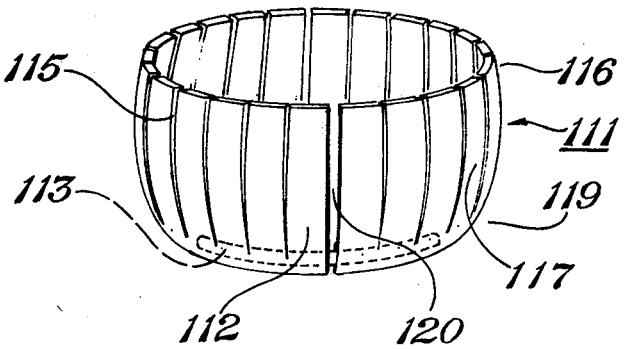
Fig. 3
Fig. 4
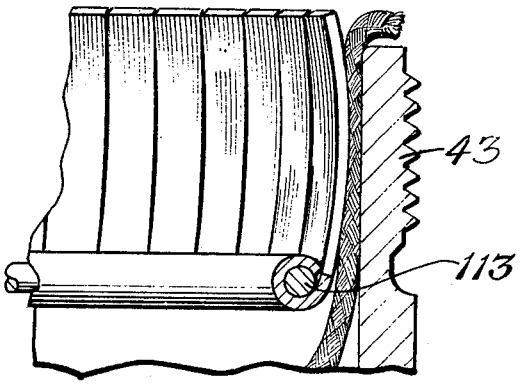

SHIELD TERMINATION MEANS FOR ELECTRICAL CONNECTOR

BACKGROUND OF THE INVENTION

1. Field of the Invention

This invention relates to shield termination means for shields of individual wire leads and/or for a bulk cable shield.

2. Description of the Prior Art

Heretofore shields from electrical leads or cables have been terminated at a connector by time consuming or ineffective means. For example, inside of a connector body, a wire is connected to the shields which is brought out and attached to the connector by way of a clamp. This procedure can be very time consuming. In another example, shields have been clamped between two solid rings surrounding the cable which are electrically coupled to the connector. This shield termination arrangement has disadvantages since irregularities in the size of the shields may result in ineffective electrical connection between the shields and the solid rings.

SUMMARY OF THE INVENTION

It is an object of the present invention to provide an novel shield termination means which is easy to assemble and use and which provides an effective connection to the shield or shields.

It is a further object of the present invention to provide a shield termination means which may be used to terminate the shields of individual wire leads and/or the bulk shield of a cable and which may be employed inside of a back shell accessory body of an electrical connector or around the cable leading into the accessory body.

The shield termination means comprises an annular metalic means comprising a plurality of axially extending flexible fingers to be located around the leads or cable with the individual lead shields and/or the bulk cable shield engaging the fingers.

BRIEF DESCRIPTION OF THE DRAWINGS

FIG. 2 illustrates another embodiment of the shield termination means of the present invention.

FIG. 3 illustrates a further embodiment of the shield termination means of the present invention.

FIG. 4 is an enlarged partial cross-sectional veiw of the shield termination means of FIG. 3.

FIG. 7 illustrates a separate finger element with interlocking means for assembling another embodiment of a shield termination means of the present invention.

FIG. 8 is a view of the finger element of FIG. 7 taken along the lines 8—8 thereof. In FIG. 8, the finger element shown in dotted lines on the right is interlocked with the finger element shown on the left.

DESCRIPTION OF THE PREFERRED EMBODIMENT

Figure 1:
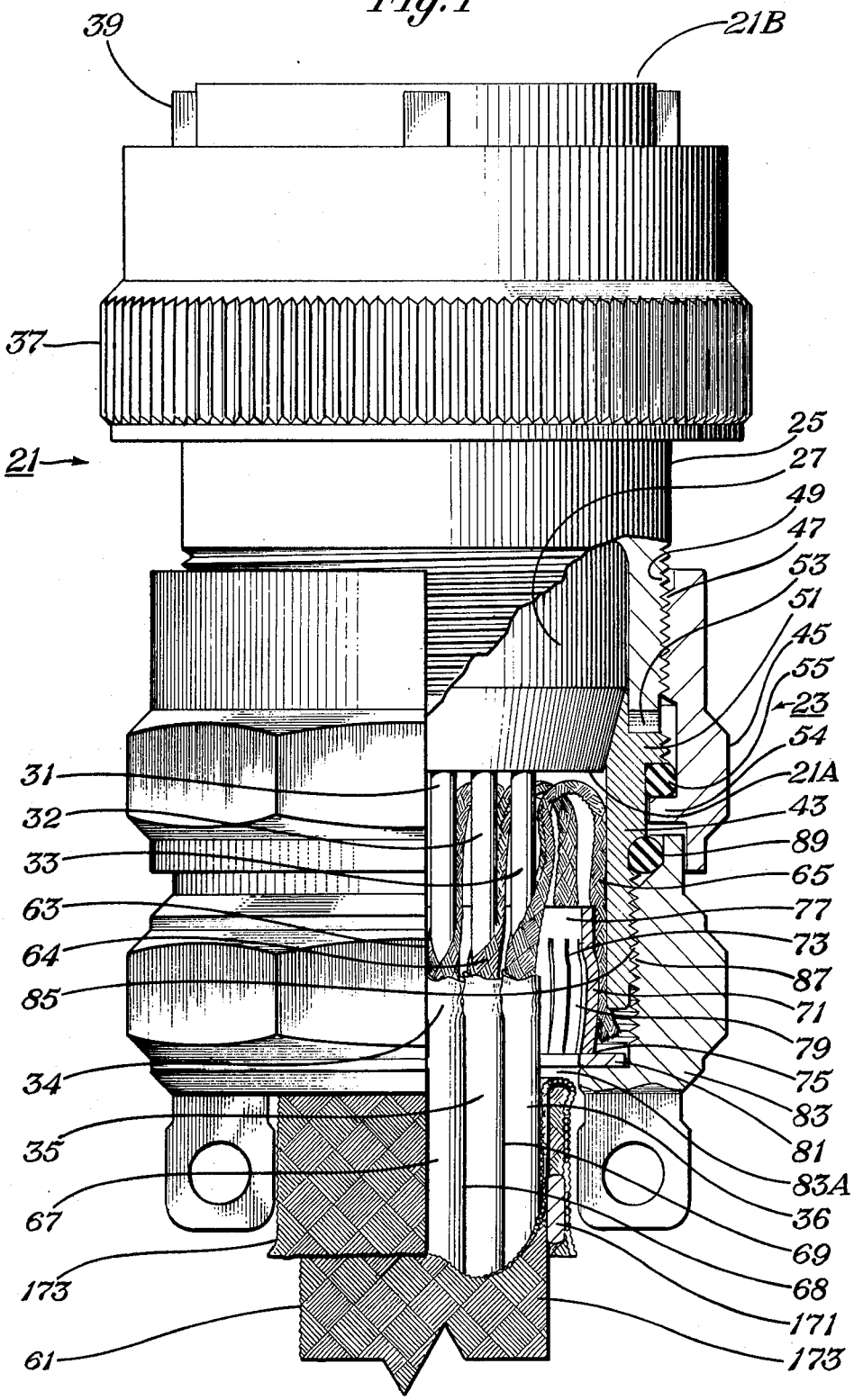
FIG. 1 is a side view of an electrical connector with a back shell accessory body with two separate shield termination means of the present invention for terminating individual wire shields and the bulk cable shield.

Referring now to FIG. 1, there is disclosed an electrical connector 21 having a back shell accessory means 23 coupled to its rear end. The electric connector 21 comprises a hollow cylindrical connector body 25 having located therein a rubber grommet 27 which supports a plurality of electrical contacts, not shown. The electrical contacts have rear ends adapted to be connected to electrical wires of leads at the rear end 21A of the connector. In FIG. 1, three wires 31, 32, and 33 of electrical leads 34, 35, and 36 are shown extending to the grommet 27 where they are connected to the rear ends of the contacts. The contacts extend through the grommet 27 to its front end terminating in either male or female terminals at the front end 21B of the connector for connection to mating terminals of another connector. Coupling member 37 is rotatably located around connector body 25 for coupling with a mating member of the other connector. Members 39 are keys secured to the outside of the front portion of the connector body 21 which slides into mating keyways of the other connector.

At the rear or back side of the connector 21, a hollow cylindrical back shell accessory body 43 is coupled to the connector body 25 by way of a coupling nut 45. The accessory body 43 and coupling nut 45 are of the type disclosed and claimed in U.S. Pat. No. 4,066,314. The nut 45 is coupled to the connector body 25 by threads 47 which mate with threads 49 of the connector body. The accessory body 43 is located within the coupling nut 45 by threading its outer shoulder 51 through the threads 47 of the nut 45 to the position shown prior to threading the nut 45 to the connector body 25. Although not shown, the rear end of the connector body 25 has teeth which mate with teeth formed on the front end of the outer shoulder 51 of the accessory body 43 to prevent the accessory body from rotating relative to connector body 25 after it has been secured in place by the coupling nut 45. Reference numeral 53 indicates the tooth engaging area for the mating teeth which are of the type disclosed in FIGS. 6 and 7 of U.S. Pat. No. 4,066,314. Located between the outer shoulder 51 of the accessory body 43 and inner shoulder 54 of the coupling nut 45 is a resilient O-ring 55.

Extending through the rear end of the accessory body 23 are the leads 34–36 of an electrical cable 61. Although only three leads are shown, it is to be understood that the cable 61 may have more leads. Surrounding the wires 31, 32, and 33 of the leads are metalic shields 63, 64, and 65 which are covered by insulating jackets 67, 68, and 69. The individual shields of the leads are terminated by stripping the insulating jackets from the ends of the leads, slitting the shields and folding them backwards against the inside wall of the accessory body 43 at its rear end as shown in FIG. 1. An annular metalic shield terminating member 71 is fitted inside the body 43 from its rear end tightly wedging the shields of the individual leads between the outside portion of the member 71 and the inside surface of the accessory body 43.

In the embodiment of FIG. 1, the member 71 is a single hollow cylindrical member having a plurality of spaced apart axial slits 73 formed in its end 75 and which extends toward its opposite end 77 defining a plurality of axially extending bendable and flexible fingers 79. The end 77 of the member 71 is a solid ring portion having an outside diameter slightly less than the portion defined by the fingers 79. This allows the end 77 of the member 71 to be readily slid past the shields. The fingers 79 bow outward and provide compression for securly holding the shields against the inside wall of the accessory body. Since the fingers 79 can move relative to each other, they will insure that good electrical contact is had between all of the individual shields and the inside wall of the accessory body 43 even though the size of the shields may vary. In this respect, if the member 71 were a solid ring, a large shield next to a smaller shield may result in poor electrical contact between the smaller shield and the accessory body since the larger shield may hold the solid ring away from the accessory body wall a distance sufficient to prevent good electrical contact between the smaller shield and the accessory body wall. With the shield termination means 71, however, the position of one finger does not effect the position of an adjacent finger thereby allowing one finger to effectively engage a large shield and force it against the accessory back body wall and to effectively engage a smaller shield and also force it against the accessory body wall. Moreover, the shield termination means 71 is easy to install and allows one to readily determine if all of the shields are effectively engaging the accessory body wall by merely looking at the rear end of the back shell accessory body before the washer 81 and the rear end cover nut 83 are installed. The purpose of the washer 81 and nut 83 is to tighten and hold the shield termination means 71 in place and to provide protection at the rear of the accessory body for the components located inside of the accessory body. As can be seen, the rear end cover nut 83 is coupled to the rear end of the accessory body by inner threads 85 which mate with outer threads 87 formed at the rear end of the accessory body 43. A resilient O-ring 89 is located between the accessory body 43 and the front end of the nut 83.

Referring to FIG. 2, there is disclosed another embodiment of a shield termination means identified at 91. It comprises a hollow annular metalic member having an outside diameter at end 93 which is less than the outside diameter of end 95. A plurality of axial slits 97 are formed in end 95 which extend toward end 93 defining a plurality of flexible and bendable axial fingers 99. A plurality of axial slits 101 are formed in end 93 which extend toward end 95 defining a plurality of flexible and bendable axial fingers 103. As shown, the slits 101 are twice as far apart as slits 97 and extend into alternate fingers 99. Thus there are twice as many fingers 99 as fingers 103. In use, the smaller end 93 of the shield termination means 91 is inserted first into the accessory body with the individual shields folded back and located between the outer portion of means 91 and the inner wall of the accessory body. The fingers 99 act to compress the individual shields against inner wall of the accessory body. The shield termination means 91 is preferred over the shield termination means 71 since its forward end 93 is more flexible thereby allowing the end 93 to better accommodate individual shields of different sizes and the bulk shield of the cable as will be discussed subsequently.

Referring now to FIG. 3, the shield termination means of this embodiment is identified at 111. It comprises a metallic member 112 bent into a ring with one end folded around an arculate shaped wire member 113. The wire may be tightly secured in the fold of one side and located in the fold of the other side of the member 112 with a friction fit thereby allowing the ring to be expanded to fit within accessory bodies of different sizes. Slits 115 are formed in the end 116 of the member 112 resulting in a plurality of axial fingers 117 when the member is bent into a ring. As shown, the end 119 of the device 111 has an outside diameter less than the portion defined by the bowed fingers midway between ends 116 and 119. The end 119 of the device 111 is inserted first into the accessory body with the individual shields folded back and located between the outer portion of the fingers 117 of the member 111 and the inner wall of the accessory body as shown in FIG. 4. If desired, the wire 113 may be tightly secured in the folds of both sides of the member 112 with its sides brought together eliminating the gap 120.

Figure 5:
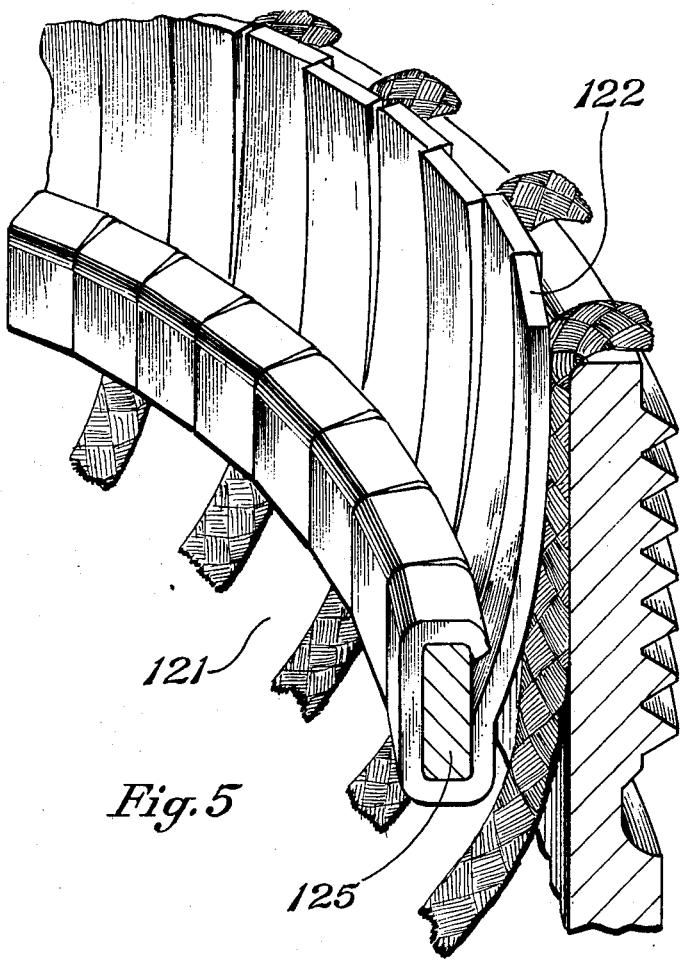
FIGS. 5 and 6 illustrate still further embodiments of a shield termination means of the present invention which are assembled from separate finger elements.

In the embodiment of FIG. 5, the shield termination means 121 is formed by a plurality of separate flat metalic spring fingers 122, each having one end bent around a split or continuous ring 123 with the fingers extending axially. The cross-section of the ring 123 is square or rectangular in shape to resist the loading moment caused by the spring fingers. With a split ring 123, the shield termination means can be expanded to fit within accessory bodies of different sizes. The fingers can be secured around the ring with a tight or slip fit. As shown, the ring end of the shield termination means 121 has an outside diameter which is smaller than the portion defined by the bowed fingers. The ring end is inserted first into the accessory body with the shields folded back and located between the fingers and the inner wall of the accessory body.

Figure 6:
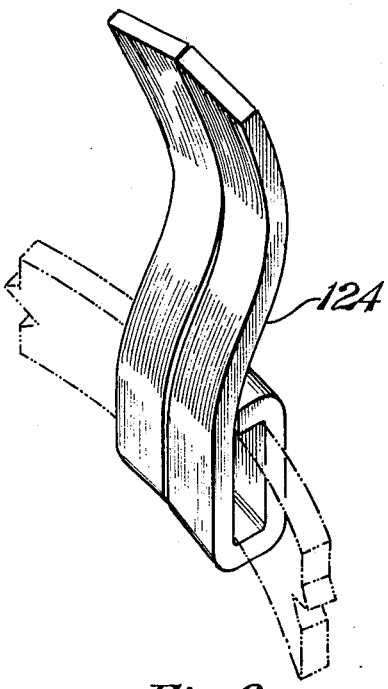

In the embodiment of FIG. 6, the shield termination means is formed in the same manner as that of FIG. 5 but the fingers 124 are bent around the ring in an opposite direction.

Referring now to FIGS. 7 and 8, there is illustrated a finger element 131 formed from an L-shaped flat metalic spring member having one end bent to form a flexible finger 133 with a slot 135 and a tongue 137 at one end thereof. A plurality of the finger elements 131 may be assembled together with the tongue of one element located in the slot of an adjacent element, as seen in FIG. 8 to form an annular shield termination means with a plurality of axially extending fingers. Each finger element 131 has a male tab 139 and a female opening 141 which mate respectively with a female opening and a male tab of an adjacent finger element for interlocking purposes. The resulting shield termination means formed has an end defined by the slot and tongue portion with an outside diameter which is smaller than the mid-portion defined by its bowed fingers. The end of the shield termination means defined by the slot and tongue portions is fitted first into the accessory body with the shields folded back and located between the fingers and the inner wall of the body. The use of the individual finger elements 131 to form a shield termination means has advantages since a single die may be employed to make the finger elements which then can be assembled to form shield termination means of different sizes to fit accessory bodies of different sizes.

Figure 9:
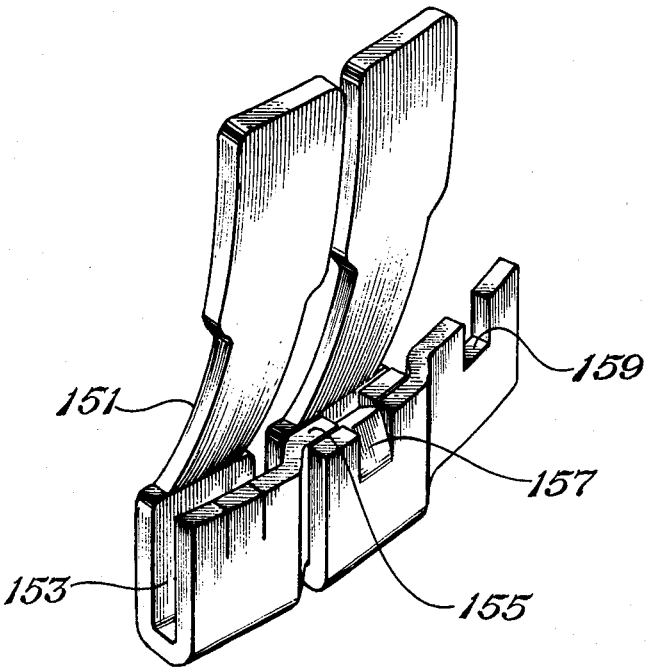
FIGS. 9 and 10 illustrates other types of finger elements with interlocking means for assembling other embodiments of the shield termination means of the present invention.
Figure 10:
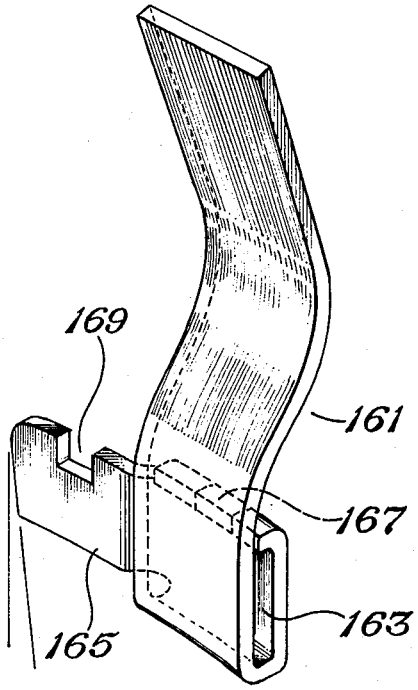

FIGS. 9 and 10 each disclose slightly different metallic finger elements 151 and 161 with slots and tongues which allow a plurality of the elements to be assembled together to form annular shield termination means with axially extending flexible fingers for securing shields against the inner wall of an accessory body. Each of the elements 151 and 161 has male tabs and female openings for interlocking purposes. In FIG. 9, reference numerals 153 and 155 identify the slot and tongue respectively of a finger element 151 and reference numerals 157 and 159 identify the interlocking male tab and female opening respectively. Two elements 151 are shown assembled together in FIG. 9 for the formation of a desired annular shield termination means. In FIG. 10, reference numerals 163 and 165 identify the slot and tongue respectively of element 161 and reference numerals 167 and 169 identify the interlocking male tab and female opening respectively of the element 161. The end of the tongue 165 of element 161 has a cant to resist moment developed by spring loading. A plurality of the elements 161 can be assembled together to form a desired annular shield termination means.

The finger elements of FIGS. 9 and 10 have the same advantages as that of the elements of FIGS. 7 and 8 in that only one die is required to form the elements 151 and only one die is required to form the elements 161. Like elements 151 and 161 may be assembled together to form annular shield termination means of different sizes. The shield termination means formed from elements 151 and 161 will have ends defined by the slot and tongue portions with smaller outside diameters than the mid portions defined by the bowed fingers. The smaller ends are fitted first into the accessory body with the shields folded back and located between the fingers and the inner wall of the accessory body.

In FIG. 1, a separate annular metallic shield termination means 171 with axially extending fingers is employed for terminating the bulk cable shield 173 surrounding all of the leads of the cable 61. The shield termination means 171 is of the type shown in FIG. 2 having slits formed in opposite ends to form a plurality of flexible axially extending fingers at opposite ends with more fingers being formed at one end than at the other end. The inside diameter of means 171 is the same, however, at opposite ends as seen in FIG. 1. The outside diameter of means 171 at opposite ends is enlarged to accommodate a two-piece strap clamp. Since the shield termination means 171 has flexible fingers at both ends, it can be slightly undersized in inside diameter thereby allowing it to fit tightly around the bulk cable shield 173. In the installation process, the shield termination means 171 is located around the bulk shield 173 prior to attachment of the lead wires 31–33 to the connector contacts. After the individual shields 63–65 are secured against the inside wall of the accessory body by one of the shield termination means as described previously, the shield termination means 171 is slid forward and the end of the bulk shield 173 folded backward and clamped in place to the shield termination means. Due to the lack of space in FIG. 1, all of the details of the cable 61 and the clamping arrangement of the bulk shield 173 to the shield termination means 171 is not shown.

Figure 11:
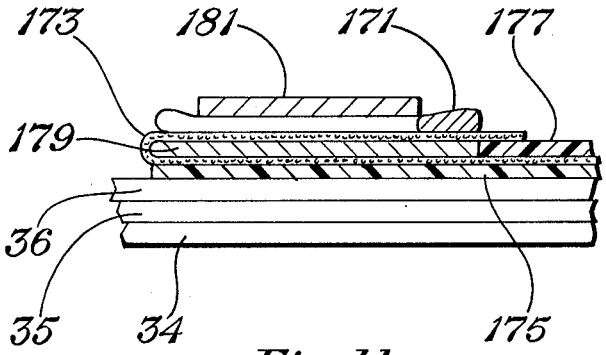
FIG. 11 is a cross-sectional view of a cable illustrating a preferred manner for terminating the bulk cable shield with a shield termination means.

References now made to FIG. 11 for a more complete description of the preferred manner of terminating the bulk shield of 173 to the shield termination means 171. In this figure, the individual leads are shown at 34–36; the bulk shield is identified at 173; and the shield termination means is identified at 171. Reference numerals 175 and 177 identify the inner and outer cable insulating jackets respectively. The outer jacket has been cut short and a hard aluminum tube 179 positioned in its place at the forward end to prevent crushing of the leads. The bulk shield 173 is folded backward over tube 179 and the shield termination means 171 located around the folded portion of the bulk shield 171. Reference number 181 identifies one member of a two-piece strap clamp located around the member 171 and clamped in place by two bolts. FIG. 5 of U.S. Pat. No. 4,066,314 illustrates the type of two-piece strap clamp which may be used. The clamp will be electrically connected to or located to engage the cover nut 83. In the event that the inside of the accessory body is rectangular in cross-section, the individual shields of the wire leads may be terminated by folding them backwards out through the opening 83A (see FIG. 1) of the rear cover nut 83 and locating them between the inside surface of the fingers of the shield termination means 171 and the folded portion of the bulk shield 173 prior to installation of the clamp 181.

Figure 12:
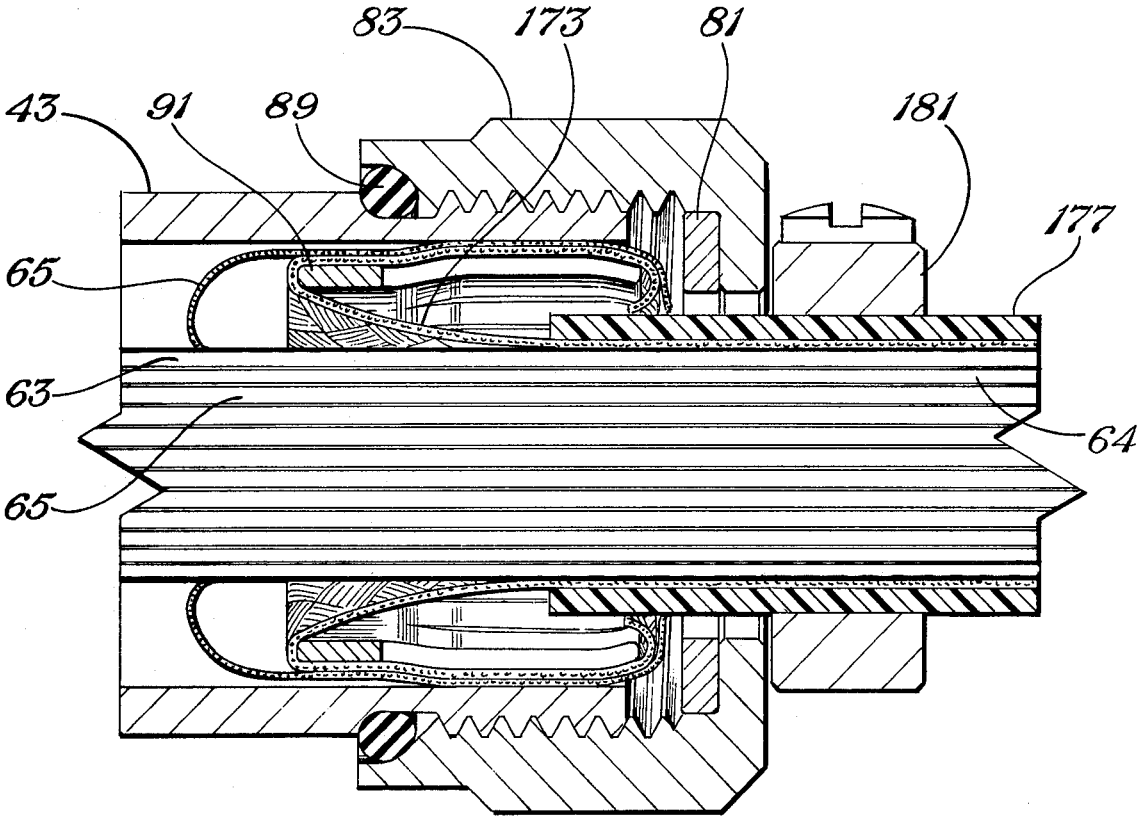
FIG. 12 is a partial cross-sectional view of a back shell accessory body illustrating the bulk cable shield and individual shields terminated with a shield termination means on the inside of the accessory body.

Referring now to FIG. 12, there is illustrated a manner in which the bulk shield 171 may be terminated inside of the accessory body using the shield termination means 91 of FIG. 1 or the shield termination means of FIGS. 2–10. In FIG. 12, the shield termination means 91 of FIG. 2 is illustrated. The bulk shield 173 is terminated by bringing its end forward inside the accessory body and folding it backward against the inner wall of the accessory body with the individual shields, one of which is identified at 65, located between the bulk shield 173 and the inner wall of the accessory body. The shield termination means 91 is then fitted in place, compressing both the bulk shield and the individual shields against the inner wall of the accessory body.

While the invention has been shown in only the preferred form, it should be apparent that it is not limited to this particular form but is susceptible to various changes and modifications without departing from the spirit or the scope thereof.

I claim:

1. Electrical connector means, comprising:

a body having a central opening for receiving electrical leads through a first end, an electrical connector coupled to the opposite end of said body, said electrical leads being connected to said electrical connector, shield means surrounding said electrical leads, and annular shield termination means comprising a plurality of axially extending flexible fingers located around said leads in said opening at said first end of said body with a portion of said shield means being held against the inner wall of said body by the outer portions of said fingers of said annular shield termination means, said fingers defining a portion of said shield termination means having an outside diameter greater than that of one end of said shield termination means, said shield termination means being located within said opening of said body such that said one end is closer to said electrical connector than the other end thereof.

2. The electrical connector means of claim 1, wherein:

said shield termination means comprises a single member having a plurality of axial slits formed through its wall at said other end defining a plurality of flexible axial fingers at said other end.

3. Electrical connector means, comprising:

a body having a central opening for receiving electrical leads through a first end, an electrical connector coupled to the opposite end of said body, said electrical leads being connected to said electrical connector, shield means surrounding said electrical leads, and annular shield termination means comprising a plurality of axially extending flexible fingers located around said leads with said shield means being engaged by said fingers of said annular shield termination means, said annular shield termination means being located in said opening at said first end of said body for securing said shield means to said body between the outer portions of said fingers of said annular shield termination means and the inner wall of said body, said fingers defining a portion of said shield termination means having an outside diameter greater than that of one end of said shield termination means, said shield termination means being located within said opening of said body such that said one end is closer to said electrical connector than the other end thereof, said shield termination means comprising a single member having a plurality of axial slits formed through its wall at said one end and at said other end defining flexible fingers at opposite ends thereof.

4. The electrical connector means of claim 3, wherein:

said shield termination means has more of said slits formed at said other end than at said one end such that said other end has more flexible fingers than said one end.

5. The electrical connector means of claim 2, wherein:

said one end of said shield termination means is secured to an arcuate member by being bent around said arcuate member.

6. Electrical connector means, comprising:

a body having a central opening for receiving electrical leads through a first end, an electrical connector coupled to the opposite end of said body, said electrical leads being connected to said electrical connector, shield means surrounding said electrical leads, and annular shield termination means comprising a plurality of axially extending flexible fingers located around said leads with said shield means being engaged by said fingers of said annular shield termination means, said annular shield termination means being located in said opening at said first end of said body for securing said shield means to said body between the outer portions of said fingers of said annular shield termination means and the inner wall of said body, said fingers defining a portion of said shield termination means having an outside diameter greater than that of one end of said shield termination means, said shield termination means being located within said opening of said body such that said one end is closer to said electrical connector than the other end thereof, said shield termination means comprising a plurality of separate elements each of which forms one of said flexible fingers.

7. The electrical connector means of claim 6, wherein:

said plurality of flexible elements are secured to an annular member at one end of said annular shield termination means.

8. The electrical connector means of claim 6, wherein:

each of said plurality of separate elements comprises means which allows it to be assembled to an adjacent one of said separate elements to form said annular shield termination means.

9. Electrical connector means, comprising:

a body having a central opening for receiving electrical leads through a first end, an electrical connector coupled to the opposite end of said body, said electrical leads being connected to said electrical connector, shield means surrounding said electrical leads, and annular shield termination means comprising a plurality of axially extending flexible fingers located around said leads with said shield means being engaged by said fingers of said annular shield termination means, said shield termination means comprising a single member having a plurality of axial slits formed through its wall at opposite ends defining a plurality of flexible fingers at said opposite ends of said shield termination means.

10. The electrical connector means of claim 9, wherein:

said shield termination means has more of said slits formed at second end than at first end whereby said second end has more flexible fingers than said first end.

11. Electrical connector means, comprising:

a body having a central opening for receiving electrical leads through a first end, an electrical connector coupled to the opposite end of said body, said electrical leads being connected to said electrical connector, shield means surrounding said electrical leads, and annular shield termination means comprising a plurality of axially extending flexible fingers located around said leads with said shield means being engaged by said fingers of said annular shield termination means, said shield termination means comprising a single member having first and second opposite ends with a plurality of axial slits formed through its wall at said second end defining a plurality of flexible fingers at said second end, said first end of shield termination means being secured to an arcuate member by being bent around said arcuate member.

12. Electrical connector means, comprising:

a body having a central opening for receiving electrical leads through a first end, an electrical connector coupled to the opposite end of said body, said electrical leads being connected to said electrical connector, shield means surrounding said electrical leads, and annular shield termination means comprising a plurality of axially extending flexible fingers located around said leads with said shield means being engaged by said fingers of said annular shield termination means, said shield termination means comprising a plurality of separate elements each of which forms one of said flexible fingers.

13. The electrical connector of claim 12, wherein:

each of said plurality of separate elements are secured to an annular member at one end thereof.

14. The electrical connector means of claim 12, wherein:

each of said plurality of said separate elements comprises means which allows it to be assembled to an adjacent one of said separate elements to form said annular shield termination means.

15. Electrical connector means, comprising:

a body having a central opening for receiving electrical leads through a first end, an electrical connector coupled to the opposite end of said body, said electrical leads being connected to said electrical connector, shield means surrounding said electrical leads, and annular shield termination means comprising a plurality of axially extending flexible fingers located around said leads with said shield means being engaged by said fingers of said annular shield termination means, said annular shield termination means being located around said leads outside of said opening of said body, said annular shield termination means comprising a single member having first and second opposite ends with a plurality of axial slits formed through its wall at said opposite ends thereof, defining a plurality of flexible fingers at said opposite ends.

16. The electrical connector means of claim 15, wherein:

said shield termination means has more of said slits formed at said second end than at said first end wherein said second end has more flexible fingers than said first end.

17. A shield termination means for terminating shield means of an electrical lead means of an electrical connector comprising:

an annular metallic shield termination means comprising a plurality of axially extending flexible fingers adapted to be located around said electrical lead means with said fingers engaging said shield means, said shield termination means comprising a plurality of separate elements each of which forms one of said flexible fingers.

18. The shield termination means of claim 17, wherein:

each of said plurality of separate elements are secured to an annular member at one end thereof.

19. The shield termination means of claim 17, wherein:

each of said plurality of separate elements comprises means which allows it to be assembled to an adjacent one of said separate elements to form said annular shield termination means.

20. Electrical connector means, comprising:

a body having a central opening for receiving electrical leads through a first end, an electrical connector coupled to the opposite end of said body, said electrical leads being connected to said electrical connector, flexible shield means surrounding said electrical leads, and annular shield termination means comprising a plurality of axially extending fingers which define a portion of said shield termination means having an outside diameter greater than that of one end of said shield termination means, said annular shield termination means being located in said opening at said first end of said body such that said one end is closer to said electrical connector than the other end thereof, said electrical leads extending through said annular shield termination means, said shield means having end means located between the inner wall of said body and the outer portions of said fingers of said annular shield termination means.

21. Electrical connector means, comprising:

a body having a central opening for receiving electrical leads through a first end, an electrical connector coupled to the opposite end of said body, said electrical leads being connected to said electrical connector, flexible shield means surrounding said electrical leads, and annular shield termination means comprising a plurality of axially extending fingers which define a portion of said shield termination means having an outside diameter greater than that of one end of said shield termination means, said annular shield termination means being located in said opening at said first end of said body such that said one end is closer to said electrical connector than the other end thereof, said electrical leads extending through said annular shield termination means, said shield means extending through said annular shield termination means and being folded back and located between the inner wall of said body and the outer portions of said fingers of said annular shield termination means.

22. The electrical connector means of claim 21, wherein:

said annular shield terminating means is insertable into said opening through said first end of said body.

23. The electrical connector means of claim 21, wherein:

said shield means comprises separate shields for shielding individual ones of said leads.

24. The electrical connector means of claim 21, wherein:

said shield means comprises a shield around all of said electrical leads.

25. The electrical connector means of claim 21, wherein:

said shield means comprises separate shields for shielding individual ones of said leads and a shield around all of said electrical leads.

* * * * *